US010058919B2

(12) United States Patent
Inuzuka et al.

(10) Patent No.: US 10,058,919 B2
(45) Date of Patent: Aug. 28, 2018

(54) MANUFACTURING METHOD FOR SINTERED COMPACT

(71) Applicant: TOYOTA JIDOSHA KABUSHIKI KAISHA, Toyota-shi, Aichi-ken (JP)

(72) Inventors: Tomonori Inuzuka, Toyota (JP); Akira Kano, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 493 days.

(21) Appl. No.: 14/793,091

(22) Filed: Jul. 7, 2015

(65) Prior Publication Data

US 2016/0008885 A1 Jan. 14, 2016

(30) Foreign Application Priority Data

Jul. 8, 2014 (JP) ..... 2014-140235

(51) Int. Cl.

| | |
|---|---|
| ***B22F 3/14*** | (2006.01) |
| ***B22F 3/10*** | (2006.01) |
| ***H01F 41/02*** | (2006.01) |
| ***B22F 9/04*** | (2006.01) |
| ***H01F 1/057*** | (2006.01) |
| *B22F 3/03* | (2006.01) |

(52) U.S. Cl.

CPC ..... *B22F 3/1017* (2013.01); *B22F 3/14* (2013.01); *B22F 9/04* (2013.01); *H01F 1/0571* (2013.01); *H01F 41/0266* (2013.01); *B22F 3/03* (2013.01); *B22F 2009/048* (2013.01); *H01F 1/0577* (2013.01)

(58) Field of Classification Search

None

See application file for complete search history.

(56) References Cited

U.S. PATENT DOCUMENTS

| | | | | |
|---|---|---|---|---|
| 2006/0219323 | A1 | 10/2006 | Masuzawa et al. | |
| 2007/0245851 | A1* | 10/2007 | Sagawa | B22F 3/1021 75/10.67 |
| 2009/0218012 | A1* | 9/2009 | Hioki | H01F 1/0571 148/302 |

FOREIGN PATENT DOCUMENTS

| | | | |
|---|---|---|---|
| CN | 101770843 | A | 7/2010 |
| EP | 2207186 | A1 | 7/2010 |
| JP | 10259403 | A | 9/1998 |
| JP | 2003-342618 | A | 12/2003 |

(Continued)

*Primary Examiner* — Jessee R Roe
*Assistant Examiner* — Ngoclan T Mai
(74) *Attorney, Agent, or Firm* — Sughrue Mion, PLLC

(57) ABSTRACT

A manufacturing method for a sintered compact includes a first step in which magnetic powder is fabricated by rapid solidification, a second step in which a mass of the magnetic powder is housed in a forming mold, and preliminary heating is performed by placing the mass of the magnetic powder in a preliminary heating part of the forming mold at first temperature that is lower than coarse crystal particle generation temperature, and a third step in which main heating is performed by placing the preliminarily heated mass of the magnetic powder at second temperature that is lower than the coarse crystal particle generation temperature and higher than the first temperature, and press forming is performed while keeping temperature of the magnetic powder at densification temperature or higher.

2 Claims, 8 Drawing Sheets

(56) References Cited

FOREIGN PATENT DOCUMENTS

| | | | |
|---|---|---|---|
| JP | 2005317911 | A | 11/2005 |
| JP | 2011042837 | A | 3/2011 |

* cited by examiner 10A
5
CV
CP
6
Y3
Y4
F
X3
X4
S
3A
2A
2a
2b
4A
1

MANUFACTURING METHOD FOR SINTERED COMPACT

INCORPORATION BY REFERENCE

The disclosure of Japanese Patent Application No. 2014-140235 filed on Jul. 8, 2014 including the specification, drawings and abstract is incorporated herein by reference in its entirety.

BACKGROUND OF THE INVENTION

1. Field of the Invention

The invention relates to a manufacturing method for a sintered compact, in which magnetic powder for rare earth magnet is formed by hot pressing, thereby manufacturing a sintered compact that is a precursor of rare earth magnet.

2. Description of Related Art

Rare earth magnet that uses rare earth elements such as lanthanoid is also referred to as permanent magnet, and is used for motors that structure a hard disk and MRI, and drive motors for a hybrid vehicle, an electric vehicle, and so on.

As an index of magnetic performance of the rare earth magnet, there are residual magnetization (residual magnetic flux density) and coercivity. However, for an increase in an amount of heat generation due to size reduction and higher current density of motors, demands are growing further for heat resistance of rare earth magnet to be used. Therefore, how to maintain magnetic characteristics of magnet when used at high temperature is one of important study subjects in the art.

Rare earth magnet includes generic sintered magnet in which a scale of a crystal particle that structures the structure (main phase) is about 3~5 μm, and also nanocrystal magnet in which a crystal particle is miniaturized to a nanoscale of about 50 n~300 nm. Among them, nanocrystal magnet has now attracted attention, as nanocrystal magnet is able to reduce an addition amount of expensive heavy rare earth elements or eliminate addition of heavy rare earth elements while achieving miniaturization of the above-mentioned crystal particles.

An example of a manufacturing method for rare earth magnet is outlined. A method for manufacturing rare earth magnet (oriented magnet) is generally used, in which a quenched thin belt (a quenched ribbon), which is obtained by rapidly solidifying, for example, Nd—Fe—B-based molten metal, is fabricated, and magnetic powder fabricated by crushing the quenched thin belt is made into a sintered compact while being formed by hot pressing. Then, plastic working is performed on the sintered compact in order to give magnetic anisotropy.

When fabricating a sintered compact by hot press forming of the foregoing magnetic powder, if a mass of the magnetic powder housed in a forming mold is heated from outside to densify the magnetic powder in a short period of time, there will be a large temperature difference between an inner region and an outer region of the mass of the magnetic powder, and temperature of the outer region becomes higher than that of the inner region. Then, at a point in time when temperature of the inner region reaches temperature required for the densification, the outer region has already been exposed to an atmosphere at coarse crystal particle generation temperature or higher for a long period of time.

In a case where the magnetic powder is nanosized powder, deterioration of magnetic characteristics is unavoidable because finally obtained nanocrystal magnet contains coarse crystal particles.

In Japanese Patent Application Publication No. 2003-342618 (JP 2003-342618 A), a manufacturing method for anisotropic earth magnet powder is disclosed. In this method, preliminary heating is performed, in which a metal cylinder filled with super-quenched powder is held in an atmosphere at temperature lower than crystallization temperature of a magnet alloy, thereby allowing temperature of the super-quenched powder to reach temperature close to the atmosphere temperature. Then, the temperature is increased to about 650 to 900° C. and uniaxial compression is performed. Thus, it is possible to obtain magnet powder while preventing coarsening of particles. To be more specific, magnetic powder that is preliminarily heated in a muffle furnace is moved to a heating press and pressed.

As stated above, after preliminary heating of magnetic powder, the magnetic powder is moved to a forming mold (a heating press) for main heating. Therefore, it is not possible to avoid a problem that temperature of the magnetic powder, which is preliminarily heated to a desired temperature, is decreased. Then, when the magnetic powder is preliminarily heated to higher temperature to allow a temperature decrease of the magnetic powder, then coarsening of crystal particles could happen.

SUMMARY OF THE INVENTION

The invention provides a manufacturing method for a sintered compact, by which a sintered compact is effectively manufactured while preventing coarsening of crystal particles when manufacturing the sintered compact, which serves as a precursor of rare earth magnet, by performing hot press forming of magnetic powder made from a quenched thin belt.

An aspect of the invention relates to a manufacturing method for a sintered compact serving as a precursor of rare earth magnet. The manufacturing method includes a first step in which magnetic powder having a microscopic crystal particle is fabricated by rapid solidification, a second step in which a mass of the magnetic powder is housed in a forming mold having a preliminary heating part and a main heating part, and preliminary heating is performed by placing the mass of the magnetic powder in the preliminary heating part at first temperature $T_0$ that is lower than coarse crystal particle generation temperature, and a third step in which main heating is performed by placing the preliminarily heated mass of the magnetic powder at second temperature $T_1$ that is lower than the coarse crystal particle generation temperature and higher than the first temperature $T_0$, and press forming is performed while keeping temperature of the magnetic powder at densification temperature or higher.

In the manufacturing method according to the invention, the forming mold having the preliminary heating part and the main heating part is used, and preliminary heating of the magnetic powder is performed, and then main heating and press forming are successively performed in one forming mold. Therefore, in this manufacturing method, it is possible to manufacture a sintered compact effectively by using the forming mold having the preliminary heating part and the main heating part while preventing coarsening of crystal particles due to the preliminary heating.

Coarse crystal particle generation temperature is specified in advance (for example, 700° C.), which is defined based on a composition and so on of the magnetic powder used. Then, in the preliminary heating part of the forming mold, the magnetic powder is placed in an atmosphere at the first temperature $T_0$ (for example, 600° C.) that is lower than the coarse crystal particle generation temperature. In the mass of the magnetic powder, temperature of an inner region, which is harder to increase than that of an outer region, is increased by the preliminary heating, and, at the stage of preliminary heating, a temperature difference between the inner region and the outer region of the mass of the magnetic powder becomes small. The "coarse crystal particles" may be regarded as crystals having a maximum dimension of, for example, 400 nm or larger, in rare earth magnet that is nanocrystal magnet.

Next, main heating is performed by placing the preliminarily heated mass of magnetic powder in an atmosphere at the second temperature $T_1$ (for example, 650° C. to 700° C.) that is lower than the coarse crystal particle generation temperature and higher than the first temperature $T_0$.

For example, by setting the main heating part to 700° C., it is possible to place the preliminarily heated mass of magnetic powder in an atmosphere at temperature of 650° C. and 700° C. As stated above, the second temperature $T_1$ includes uniquely determined temperature as well as a certain range of temperature.

The "densification temperature" is temperature required to make a finally manufactured sintered compact into a dense body having a given density or higher, and 650° C., for example, may be defined as the densification temperature. For example, when a sintered compact is obtained by performing press forming of a mass of magnetic powder for a compression time of about 1 second, temperature of the magnetic powder at the time of press forming is an important element to obtain a dense sintered compact, a target relative density of which is a certain value (for example, 98%) or higher.

There are two types of embodiments, which are described later, for the forming mold having the preliminary heating part and the main heating part, and there are specific manufacturing methods when the forming molds are used, respectively.

The forming mold may include a lower die, a side die that is located above the lower die and forms a cavity with the lower die, and an upper die that is located above the side die and is able to enter and exit from the cavity, the preliminary heating part, which structures the forming mold, may perform high frequency heating above the side die and on an outer periphery of the upper die, the main heating part, which structures the forming mold, may be included in the side die, and, after the preliminary heating of the mass of the magnetic powder is performed in the preliminary heating part, the preliminarily heated mass of the magnetic powder may be housed in the cavity and press-formed while main heating is performed in the main heating part.

In order to carry out the high frequency heating, a high frequency heating coil, for example, may be arranged above the side die, in addition to the side die including the main heating part. At the stage of preliminary heating, a part of the lower die enters the side die so that no cavity is created, and the mass of the magnetic powder is mounted on the lower die, so that the high frequency heating coil is arranged around the mass of the magnetic powder. After the preliminary heating is performed by the high frequency heating, the side die is moved relatively upwardly to the lower die. Thus, the cavity is formed, and the preliminarily heated mass of the magnetic powder is automatically housed in the formed cavity.

Once the preliminarily heated mass of the magnetic powder is housed in the cavity, the temperature of the mass is increased by the main heating part built in the side die that is located on the side of the mass so that the temperature of the mass is the densification temperature or higher and lower than the coarse crystal particle generation temperature. Then, the upper die is lowered to perform press forming of the mass, thereby manufacturing a sintered compact.

By using the forming mold stated above, it is possible to carry out preliminary heating to main heating of the mass of the magnetic powder, and further to manufacturing of a sintered compact by press forming, in a series of flow. Thus, it is possible to manufacture a sintered compact effectively while preventing coarsening of crystal particles.

The forming mold may include a lower die, a side die that is located above the lower die and forms a cavity with the lower die, and an upper die that is located above the side die and is able to enter and exit from the cavity, and one of a lower region and an upper region of the side die may be a preliminary heating part, the other one may be a main heating part, and, after a mass of magnetic powder is housed and preliminarily heated in a preliminary heating cavity space corresponding to the preliminary heating part in a cavity, the preliminarily heated mass of the magnetic powder may be moved to a main heating cavity space corresponding to the main heating part and press-formed while performing main heating in the main heating part.

Since the preliminary heating part and the main heating part are built in the side die, a temperature gradient is formed within the side die. For example, in a form where the preliminary heating part is built in the lower region of the side die, and the main heating part is built in the upper region, the lower region of the cavity becomes the preliminary heating cavity space, and the upper region of the cavity becomes the main heating cavity space.

The cavity is formed by the lower die and the side die, the mass of the magnetic powder is housed in the lower preliminary heating cavity space, and preliminary heating is carried out. Thereafter, the side die is lowered relative to the lower die, and the preliminarily heated mass of the magnetic powder is moved to the main heating cavity space in the upper region of the cavity. Then, temperature of the mass is increased by the main heating part so that the temperature of the mass is the densification temperature or higher and lower than the coarse crystal particle generation temperature. Next, the upper die is lowered, and the mass is press-formed, thereby manufacturing a sintered compact.

In the case where the above-mentioned forming mold is used, it is also possible to carry out preliminary heating to main heating of the mass of the magnetic powder, and further to manufacturing of a sintered compact by press forming in a series of flow. Thus, it is possible to manufacture a sintered compact effectively while preventing coarsening of crystal particles.

As understood from the above explanation, in the manufacturing method for a sintered compact according to the invention, the forming mold having the preliminary heating part and the main heating part is used, and, preliminary heating of magnetic powder is performed and main heating and press forming are successively performed in one forming mold. Thus, it is possible to manufacture a sintered compact effectively while preventing coarsening of crystal particles due to preliminary heating.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Embodiments of a manufacturing method for a sintered compact according to the invention are explained with reference to the drawings.

First and second embodiments of a manufacturing method for a sintered compact are explained below in order. Since a first step is common to the two embodiments of the manufacturing method, the first step is explained first, and then second and third steps in each of the embodiments are explained.

(The First Step in the Manufacturing Method for a Sintered Compact)

Figure 1:
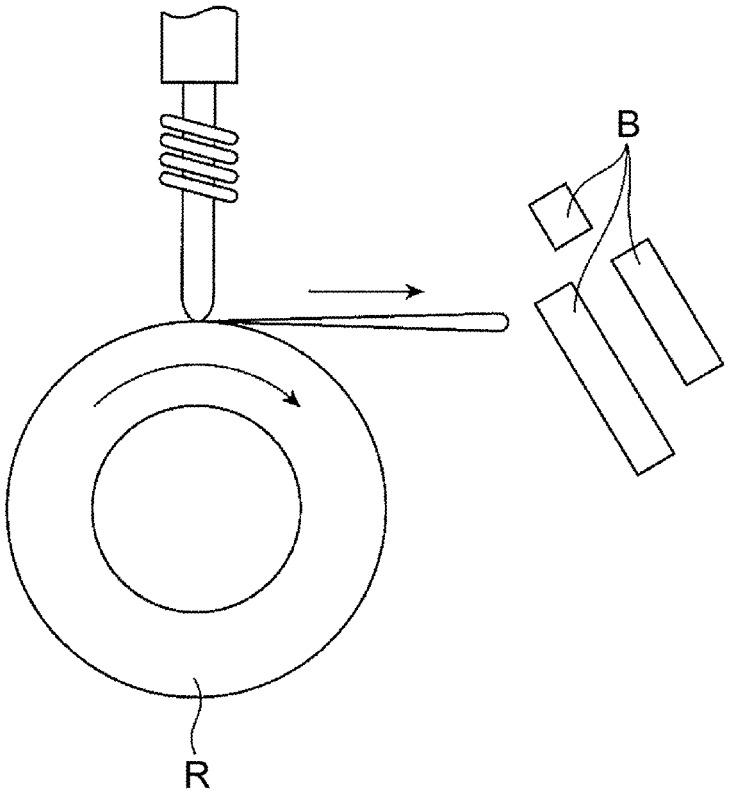
FIG. 1 is a schematic view explaining a first step of a manufacturing method for a sintered compact according to the invention.

FIG. 1 is a schematic view explaining the first step of the manufacturing method for a sintered compact according to the invention.

In the first step, a quenched thin belt, which is made of microscopic crystal particles, is fabricated by rapid solidification, and is then crushed. Thus, magnetic powder is fabricated. Specifically, as shown in FIG. 1, high frequency melting of an alloy ingot is performed in a melt spinning method by using a single roll in a furnace (not shown) in which pressure is reduced to, for example, 50 kPa or lower. Then, molten metal having a composition that is able to become rare earth magnet is injected on a copper roll R, thereby fabricating a quenched thin belt B (a quenched ribbon).

A composition of the quenched ribbon B is made of a RE-Fe—B-based main phase (RE: at least one of Nd and Pr), and a RE-X alloy around the main phase (X: a metallic element and no heavy rare earth element is contained). For example, in the case where the composition is in a nanocrystal structure, the composition is made of a main phase having a crystal particle size of about 50 nm to 300 nm.

A Nd—X alloy that structures a grain boundary phase is made of Nd and at least one or more of Co, Fe, Ga, Cu, Al, and so on. For example, the Nd—X alloy is any one of Nd—Co, Nd—Fe, Nd—Ga, Nd—Co—Fe, and Nd—Co—Fe—Ga, or a mixture of two or more of them, making the alloy Nd-rich.

The fabricated quenched ribbon B is collected and coarsely crushed, thereby fabricating magnetic powder. A particle size range of the coarsely crushed magnetic powder is adjusted to be within a range of, for example, 75 to 300 μm (the end of the first step).

Next, two methods for fabricating a sintered compact by using the magnetic powder fabricated in the first step are explained.

(The First Embodiment of the Manufacturing Method for a Sintered Compact)

Figure 2A:
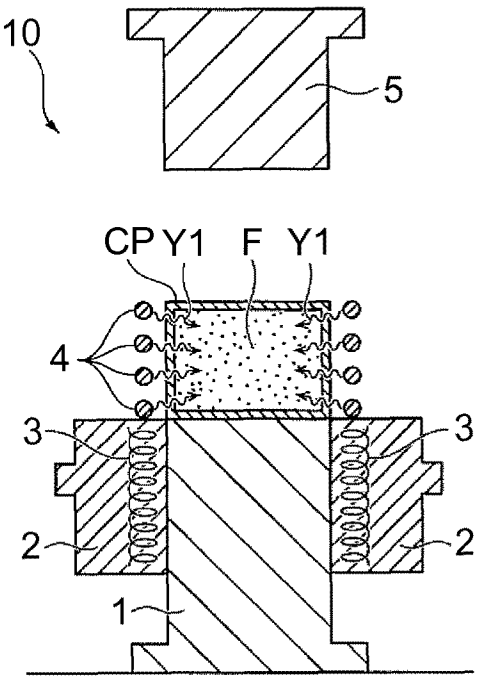
FIG. 2A to FIG. 2C are schematic views showing a first embodiment of a second step and a third step of the manufacturing method.
Figure 2B:
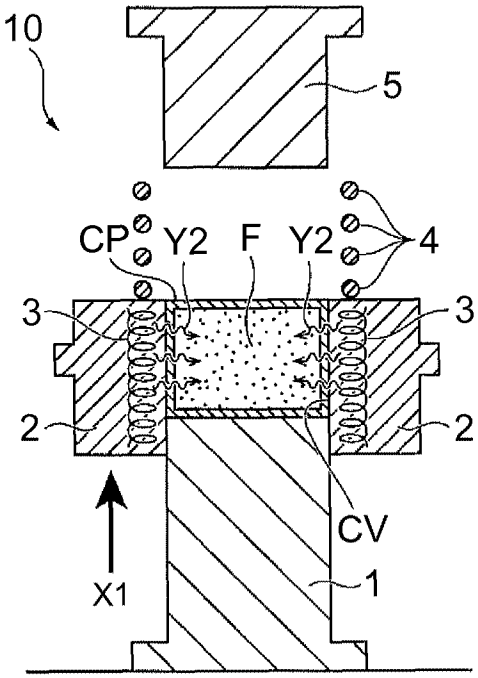
Figure 2C:
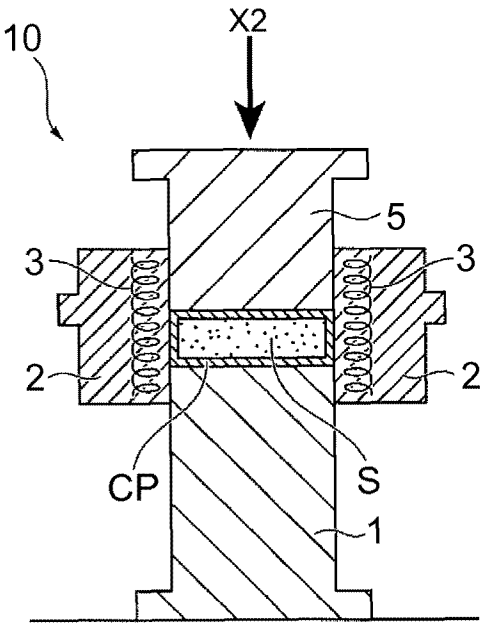

FIG. 2A to FIG. 2C are schematic views showing in this order a second step and a third step according to the first embodiment of the manufacturing method for a sintered compact.

First of all, a forming mold 10, which is used in the manufacturing method shown in the drawings, are explained. The forming mold 10 is made of a lower die 1, a side die 2 that is located above the lower die 1 and forms a cavity with the lower die 1, and an upper die 5 that is located above the side die 2 and is able to freely enter and exit from a cavity CV.

A main heating part 3 such as a heater is built in the side die 2. A preliminary heating part 4 such as a high frequency coil, which preforms high frequency heating, is arranged above the side die 2 and on an outer periphery of the upper die 5.

First, as shown in FIG. 2A, a mass of magnetic powder F is housed in a capsule CP, and the capsule CP is placed on the lower die 1 so that the preliminary heating part 4 is arranged around the capsule CP.

Next, the preliminary heating part 4 is operated. The mass of the magnetic powder F is placed in the atmosphere at first temperature $T_0$, which is lower than coarse crystal particle generation temperature, thereby performing preliminary heating for a given period of time (in Y1 directions). Thus, a preliminarily heated mass of the magnetic powder is fabricated (the second step).

Once the preliminarily heated mass of the magnetic powder is fabricated, the side die 2 is moved upwardly (in a X1 direction) as shown in FIG. 2B so that the capsule CP is surrounded by the side die 2.

In the state of FIG. 2B, the cavity CV is formed by the side die 2 and the lower die 1 due to the upward movement of the side die 2, and the capsule CP is automatically housed in the cavity CV. Then, the main heating part 3 is arranged around the capsule CP.

The main heating part 3 is operated. The preliminarily heated mass of the magnetic powder F is placed in the atmosphere at second temperature $T_1$, which is lower than the coarse crystal particle generation temperature and higher than the first temperature $T_0$, thereby performing main heating for a given period of time (in Y2 directions). Thus, the temperature of the magnetic powder becomes densification temperature or higher.

At a stage where both inner part and outer part of the mass of the magnetic powder F reach the densification temperature or higher, the upper die 5 is lowered as shown in FIG. 2C (in a X2 direction), and press forming is performed. Thus, a sintered compact S is manufactured (the third step). Here, "the inner part of the mass of the magnetic powder F" means 50% in a volume ratio of the mass on the central side, and "the outer part of the mass of the magnetic powder F" means 50% in a volume ratio of the mass on the outer side.

By using the forming mold 10 as stated above, it is possible to carry out the preliminary heating to the main heating of the mass of the magnetic powder F and further to manufacturing of the sintered compact S by press forming in a series of flow. Thus, it is possible to manufacture the sintered compact S effectively while preventing coarsening of crystal particles.

(The Second Embodiment of the Manufacturing Method for a Sintered Compact)

Figures 3A, 3B, 3C:
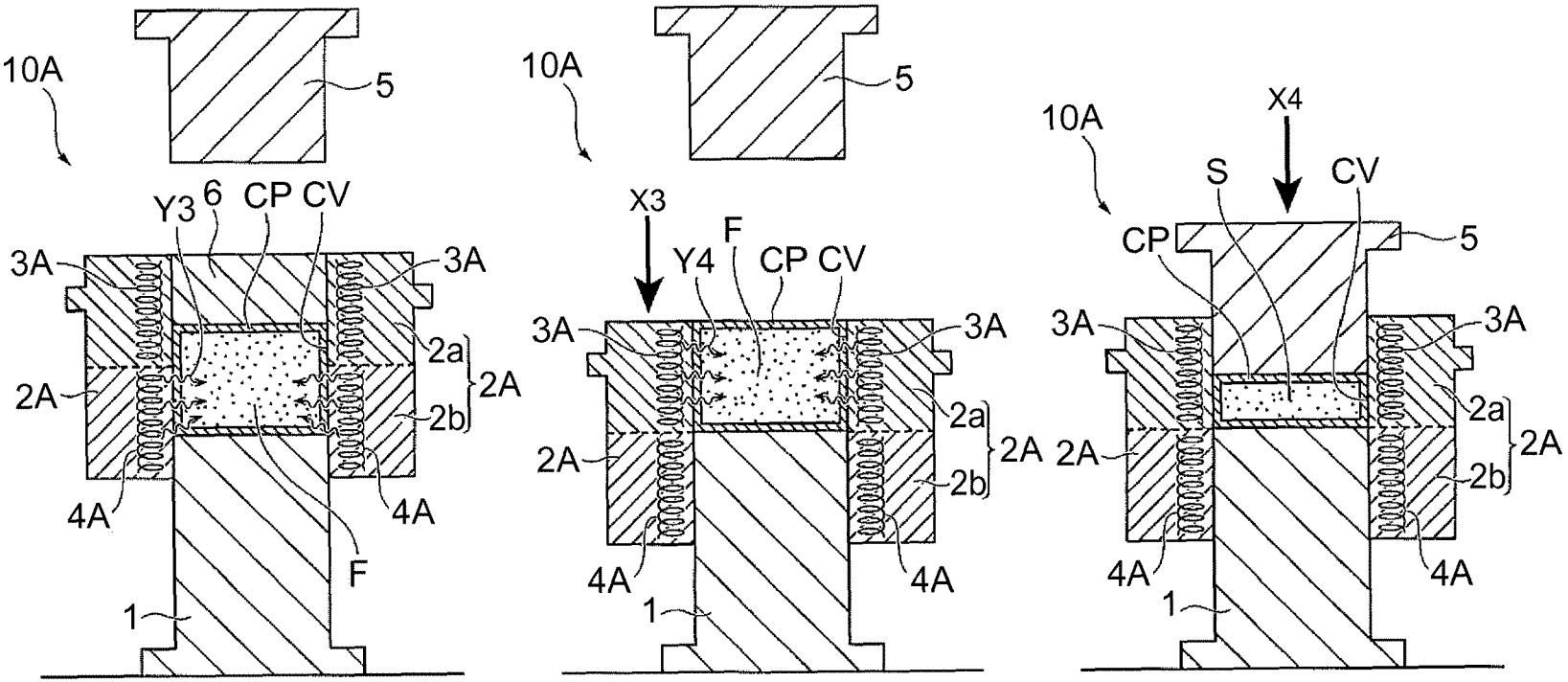
FIG. 3A to FIG. 3C are schematic views showing a second embodiment of the second step and the third step of the manufacturing method.

FIG. 3A to FIG. 3C are schematic views showing in this order the second step and the third step according to the second embodiment of the manufacturing method for a sintered compact.

A forming mold 10A used in the manufacturing method according to this embodiment is structured from a lower die 1, a side die 2A that is located above the lower die 1 and forms a cavity with the lower die 1, and an upper die 5 that is located above the side die 2A and is able to enter and exit freely from a cavity CV. A difference from the forming mold 10 shown in FIG. 2A to FIG. 2C is that a preliminary heating part 4A and a main heating part 3A are built in the side die 2A.

The side die 2A is structured from an upper region 2*a* and a lower region 2*b*, the main heating part 3A such as a heater is built in the upper region 2*a*, and the preliminary heating part 4A such as a heater is built in the lower region 2*b*.

First, as shown in FIG. 3A, a mass of magnetic powder F is housed in a capsule CP, the capsule CP is housed in the cavity CV formed by the lower die 1 and the side die 2A, and a lid 6 is placed on the capsule CP. In this state, the capsule CP is positioned in a preliminary heating cavity space in a lower part of the cavity, and the preliminary heating part 4A is arranged around the capsule CP.

Next, the preliminary heating part 4A is operated. Then, the mass of the magnetic powder F is placed in an atmosphere at the first temperature $T_0$, which is lower than the coarse crystal particle generation temperature, thereby performing preliminary heating for a given period of time (Y3 directions). Thus, a preliminarily heated mass of the magnetic powder is fabricated (the second step).

Once the preliminarily heated mass of the magnetic powder is fabricated, the side die 2A is moved downwardly (in a X3 direction) as shown in FIG. 3B. Thus, the capsule CP is positioned in a main heating cavity space, which is an upper part of the cavity CV, and the main heating part 3A is arranged around the capsule CP.

The main heating part 3A is operated. Then, the preliminarily heated mass of the magnetic powder F is placed in an atmosphere at second temperature $T_1$, which is lower than the coarse crystal particle generation temperature and higher than the first temperature $T_0$, thereby performing main heating for a given period of time (in Y4 directions). Thus, the temperature of the magnetic powder becomes densification temperature or higher.

At a stage where both inner part and outer part of the mass of the magnetic powder F reaches the densification temperature or higher, the upper die 5 is lowered as shown in FIG. 3C (in a X4 direction) and press forming is performed. Thus, a sintered compact S is manufactured (the third step).

In the case where the forming mold 10A is used as above, it is also possible to carry out the preliminary heating to the main heating of the mass of the magnetic powder F, and further to manufacturing of the sintered compact S by press forming in a series of flow. Thus, it is possible to manufacture a sintered compact effectively while preventing coarsening of coarsening of crystal particles.

(Manufacturing of Rare Earth Magnet (Oriented Magnet) from a Sintered Compact)

Figure 4:
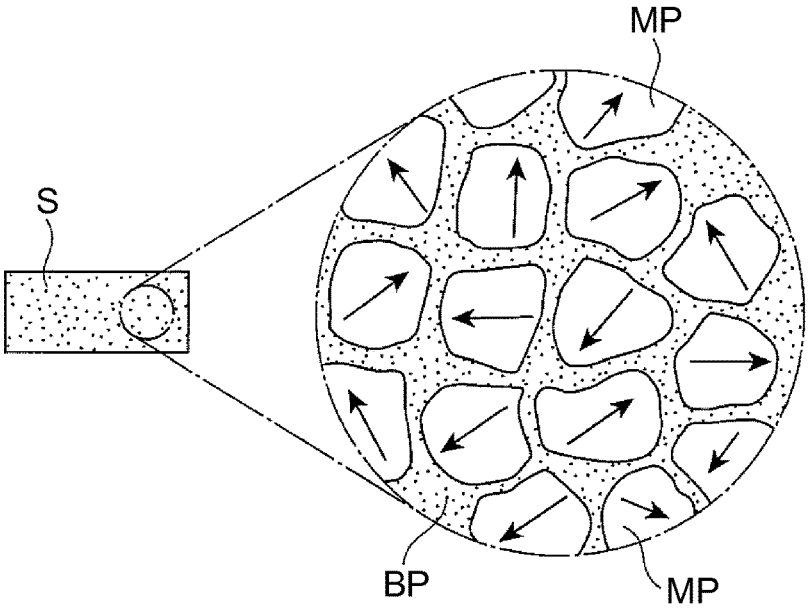
FIG. 4 is a view explaining a microstructure of a manufactured sintered compact.

FIG. 4 shows a microstructure of the sintered compact S manufactured in the manufacturing method shown in FIG. 1, FIG. 2A to FIG. 2C, or the manufacturing method shown in FIG. 1 and FIG. 3A to FIG. 3C.

As shown in FIG. 4, the sintered compact S has an isotropic crystal structure in which a grain boundary phase BP is filled between nanocrystal particles MP (the main phase).

Figure 5:
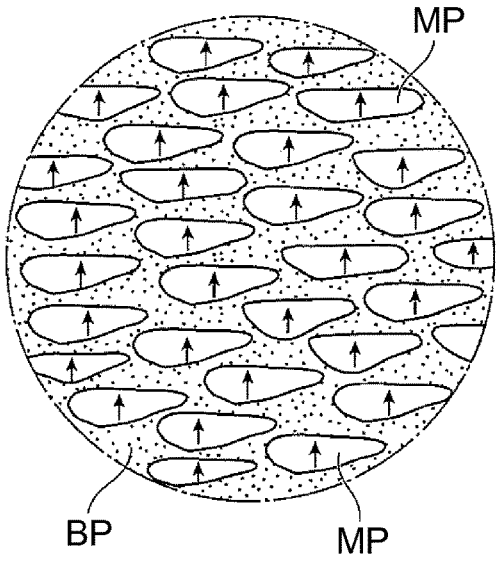
FIG. 5 is a view explaining a microstructure of manufactured rare earth magnet.

By performing hot plastic working of such an isotropic sintered compact S, rare earth magnet having a microstructure shown in FIG. 5, or rare earth magnet (oriented magnet) having magnetic anisotropy is manufactured. Extrusion such as backward extrusion and forward extrusion, and upsetting (forging) are applied to the hot plastic working.

(Experiments and the Results that Specify a Relation Between Main Heating Time and Temperature of Magnetic Powder)

Figure 6:
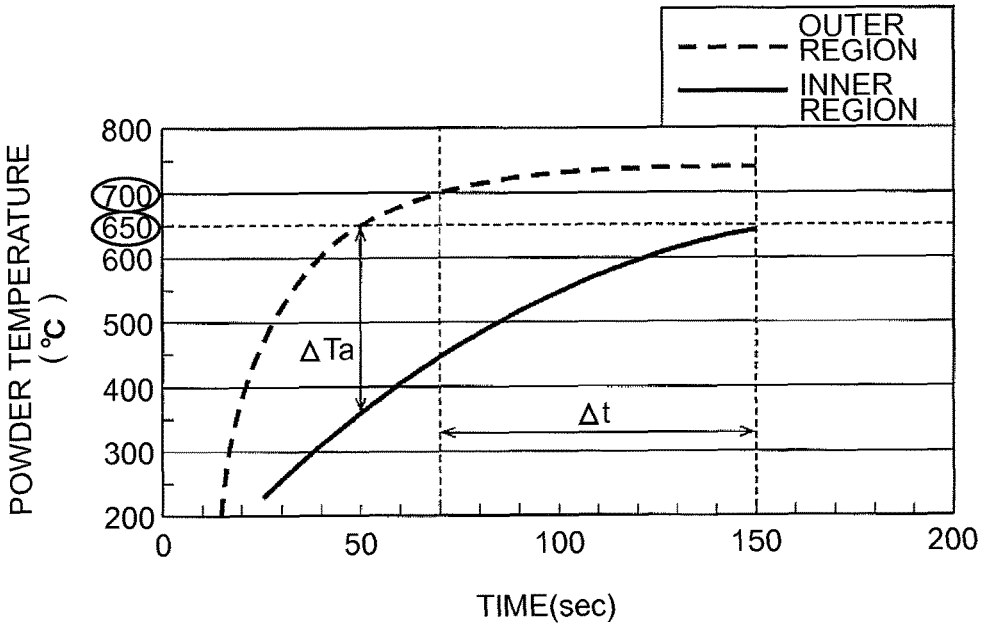
FIG. 6 is a view showing a result of a comparative example among experiment results that specify a relation between main heating time and temperature of magnetic powder.
Figure 7:
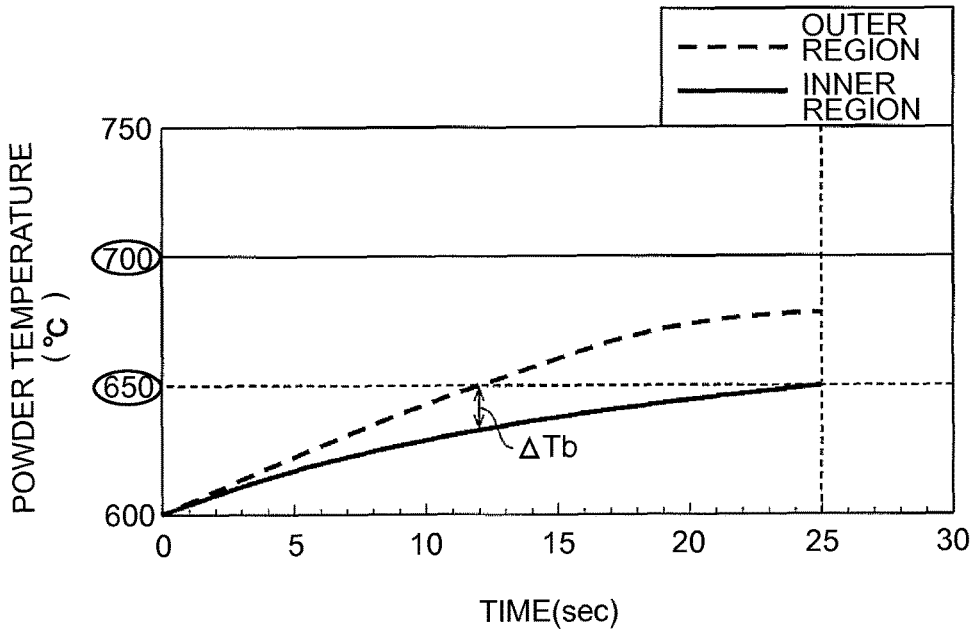
FIG. 7 is a view showing a result of an example among the experiment results that specify the relation between main heating time and temperature of magnetic powder.

The inventors and so on carried out experiments to specify a relation between main heating time and temperature of magnetic powder in the case of the manufacturing method in which main heating is performed after preliminary heating (example), and a manufacturing method in which main heating is performed without preliminary heating (comparative example). Coarse crystal particle generation temperature of magnetic powder to be used was 700° C., and densification temperature was 650° C. FIG. 6 shows the experiment result of the comparative example, and FIG. 7 shows the experiment result of the example. The "coarse crystal particles" mean crystal particles that are 400 nm or larger.

As shown in FIG. 6, in the comparative example, heating time for the mass of the magnetic powder was 150 seconds, and pressure holding time thereafter was 1 second. From the drawing, in the comparative example, a temperature difference ΔTa between an inner region and an outer region of the mass of the magnetic powder was about 300° C. at time when the outer region reached the densification temperature. This resulted in that the outer region was exposed to an atmosphere at temperature that is equal to or higher than the coarse crystal particle generation temperature for about 80 seconds. As a result, a percentage of coarse crystal particles reached 2.7%.

On the other hand, in the example, the preliminary heating time was 10 seconds. Heating time for the mass of the magnetic powder was 25 seconds as shown in FIG. 7, and pressure holding time thereafter was 1 second. According to the drawing, in the example, a temperature difference ΔTb between the inner region and the outer region of the mass of the magnetic powder was about 20° C. at time when the outer region reached the densification temperature. The temperature difference was improved considerably compared to the comparative example, and the inner region was densified sufficiently, not to mention the outer region. Further, the outer region was not placed in an atmosphere at the coarse crystal particle generation temperature or higher, not to mention the inner region. As a result, the percentage of coarse crystal particles was about 1.5%. This percentage of coarse crystal particles represents a ratio of raw material magnetic powder that is originally coarsened. Therefore, it is proved that the percentage of coarse crystal particles generated during the manufacturing processes of the sintered compact is substantially zero. It is also proved that forming time is reduced significantly in the example compared to the comparative example.

(Experiments and Results that Specify a Relation Between Temperature and a Relative Density of Magnetic Powder that Structures a Sintered Compact, and a Relation Between the Magnetic Powder Heating Time and the Percentage of Coarse Crystal Particles)

Figure 8:
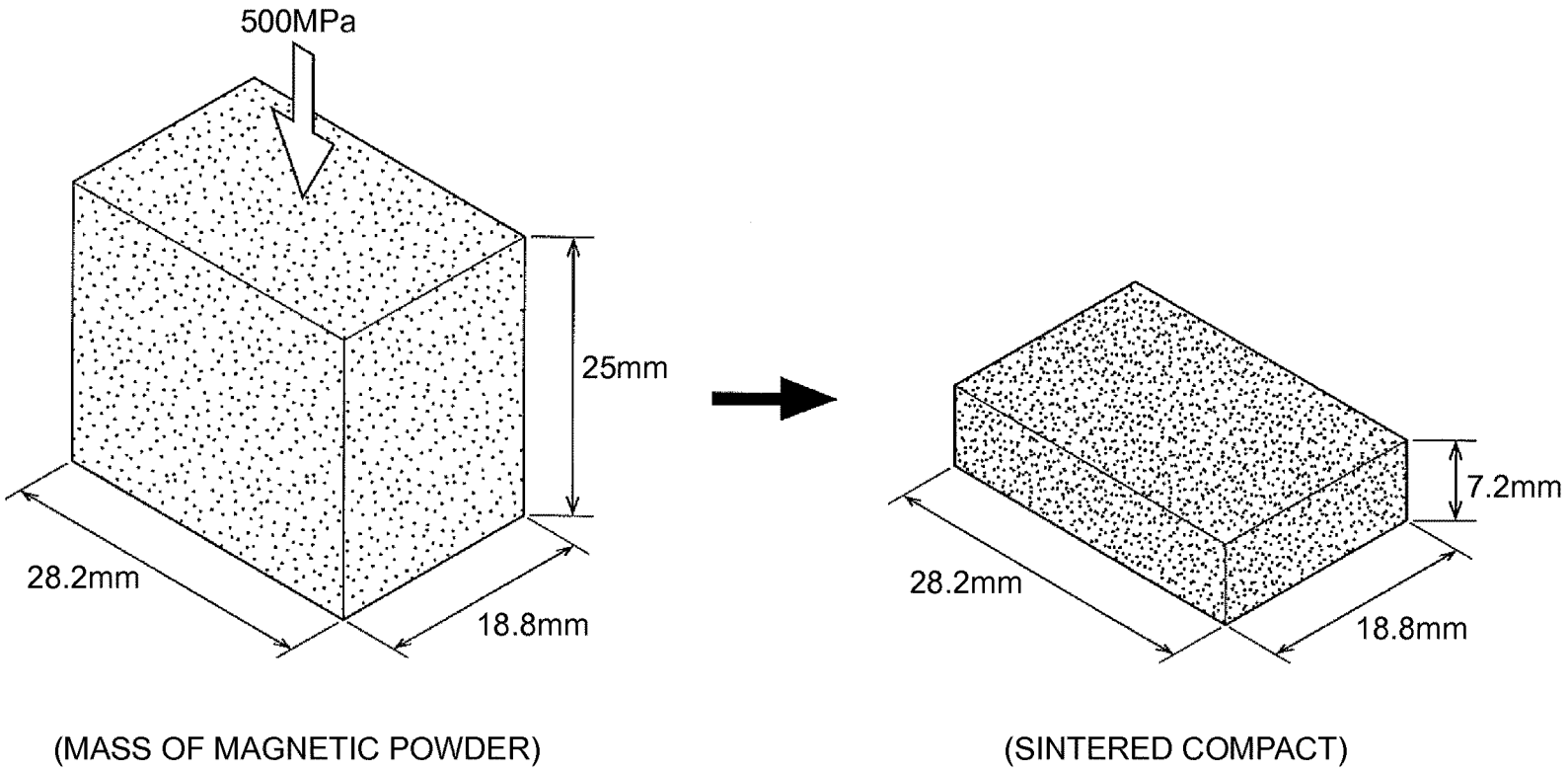
FIG. 8 is a schematic view showing dimensions of a mass of magnetic powder before press forming and a sintered compact after the press forming in the experiment.

The inventors and so on also carried out experiments to specify a relation between temperature and a relative density of magnetic powder that structures a sintered compact, and a relation between magnetic powder heating time and a percentage of coarse crystal particles. FIG. 8 is a schematic view showing dimensions of a mass of magnetic powder before press forming and a sintered compact after the press forming.

Figure 9:
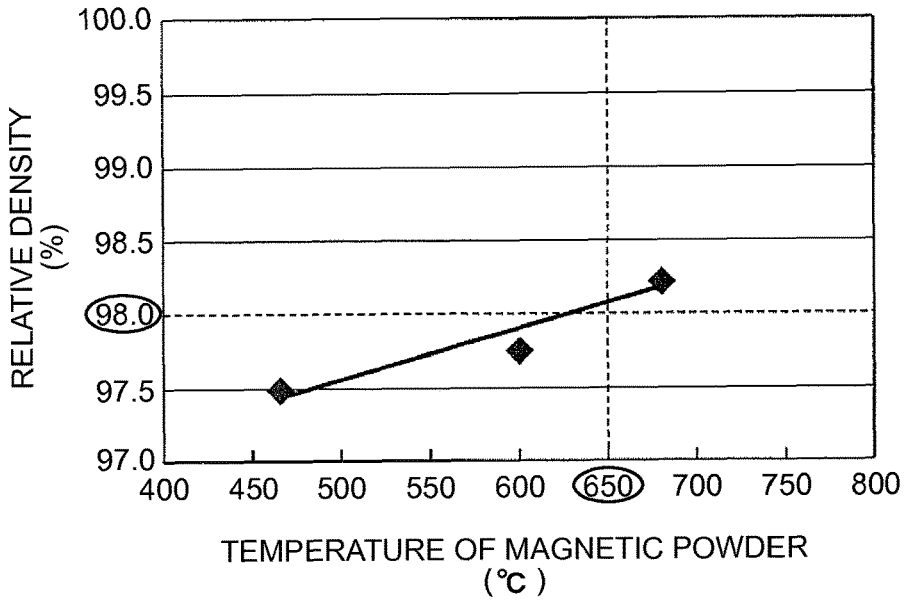
FIG. 9 is a view showing an experiment result that specifies a relation between temperature and a relative density of magnetic powder.
Figure 10:
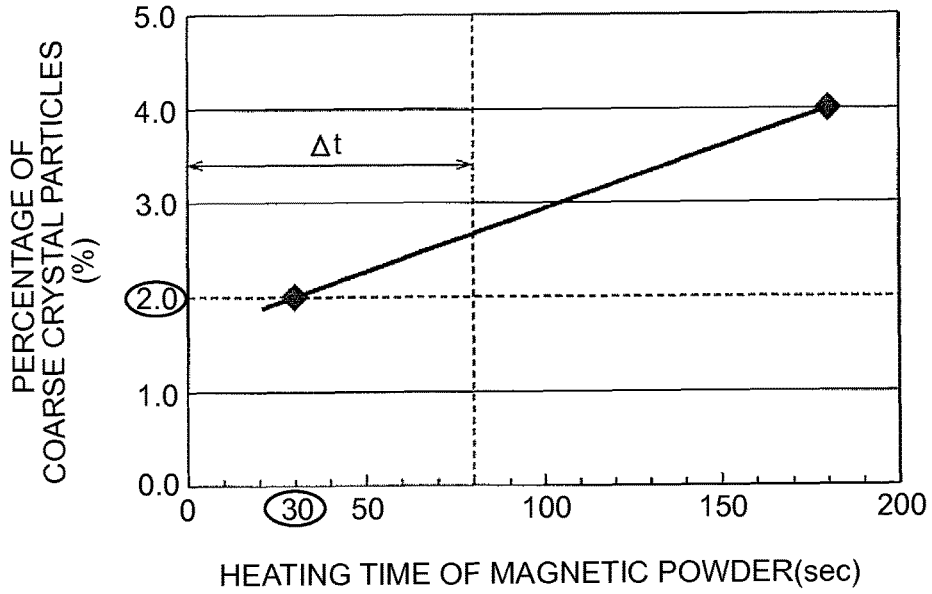
FIG. 10 is a view showing an experiment result that specifies a relation between heating time of magnetic powder and a percentage of coarse crystal particles.
Figure 11:
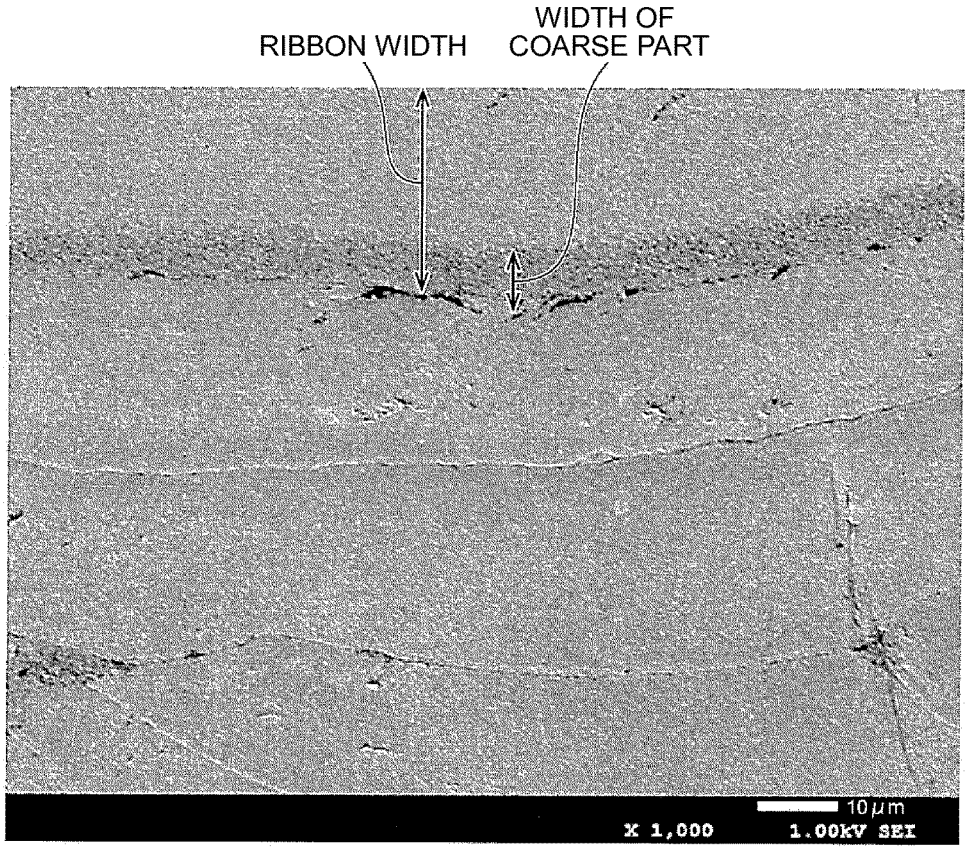
FIG. 11 is a SEM image of a section of a manufactured sintered compact.

FIG. 8 does not show the forming mold used for the press forming. In the press forming, a rectangular parallelepiped mass of the magnetic powder was pressed from above at 500 MPa and press-formed to reduce a thickness to about ⅓. Thus, a testing body of a sintered compact was obtained. FIG. 9 is a view showing an experiment result that specifies a relation between temperature and a relative density of the magnetic powder, and FIG. 10 is a view showing an experiment result that specifies a relation between heating time of the magnetic powder and a percentage of coarse crystal particles. FIG. 11 is a SEM image of a section of the fabricated sintered compact.

According to FIG. 9, it was found that the temperature of the powder needed to be 650° C. or higher in order to obtain a dense sintered compact with a target relative density of 98% or higher in one second of compression time of the magnetic powder.

In FIG. 10, exposure time Δt of the magnetic powder to 700° C. without preliminary heating was 80 seconds. According to the drawing, it was found that the exposure time of the magnetic powder at 700° C. needed to be 30 seconds or shorter in order to achieve the target percentage of coarse crystal particle of 2% or lower.

In FIG. 11, a measurement method for coarse crystal particles was SEM observation of a testing body that was etched with picral. In this drawing, it is possible to distinguish coarse crystal particles from a difference in contrast, and a black part shows coarse crystal particles. For calculation of a percentage of coarse crystal particles in FIG. 10, 10 visual fields were observed in each of upper, middle, lower, and outer parts of the sintered compact, and a percentage of coarse crystal particles was calculated from a width of coarsely crystalized part over a width of the ribbon.

The embodiments of the invention have been explained in detail with reference to the drawings. However, the specific structure is not limited to the embodiments, and design changes and so on within the gist of the invention are included in the invention.

What is claimed is:

1. A manufacturing method for a sintered compact serving as a precursor of a rare earth magnet, comprising:

a first step of fabricating magnetic powder having a microscopic crystal particle by rapid solidification;

a second step of housing a mass of the magnetic powder in a forming mold having a preliminary heating part and a main heating part, and preliminary heating the mass of the magnetic powder by placing the mass of magnetic powder in the preliminary heating part at a first temperature that is lower than a coarse crystal particle generation temperature; and a third step of main heating the preliminarily heated mass of the magnetic powder by placing the preliminarily heated mass of the magnetic powder in the main heating part at a second temperature that is lower than the coarse crystal particle generation temperature and higher than the first temperature, and performing press forming while keeping a temperature of the magnetic powder at a densification temperature or higher, wherein the forming mold includes a lower die, a side die that is located above the lower die and forms a cavity with the lower die, and an upper die that is located above the side die and is able to enter and exit from the cavity, the preliminary heating part, which structures the forming mold, performs high frequency heating above the side die and on an outer periphery of the upper die, the main heating part, which structures the forming mold, is included in the side die, and, after the preliminary heating of the mass of the magnetic powder is performed in the preliminary heating part, the preliminarily heated mass of the magnetic powder is housed in the cavity and press-formed while main heating is performed in the main heating part.

2. A manufacturing method for a sintered compact serving as a precursor of a rare earth magnet, comprising:

a first step of fabricating magnetic powder having a microscopic crystal particle by rapid solidification;

a second step of housing a mass of the magnetic powder in a forming mold having a preliminary heating part and a main heating part, and preliminary heating the mass of the magnetic powder by placing the mass of magnetic powder in the preliminary heating part at a first temperature that is lower than a coarse crystal particle generation temperature; and a third step of main heating the preliminarily heated mass of the magnetic powder by placing the preliminarily heated mass of the magnetic powder in the main heating part at a second temperature that is lower than the coarse crystal particle generation temperature and higher than the first temperature, and performing press forming while keeping a temperature of the magnetic powder at a densification temperature or higher, wherein the forming mold includes a lower die, a side die that is located above the lower die and forms a cavity with the lower die, and an upper die that is located above the side die and is able to enter and exit from the cavity, and one of a lower region and an upper region of the side die is the preliminary heating part, the other one is the main heating part, and, after the mass of the magnetic powder is housed and preliminarily heated in a preliminary heating cavity space corresponding to the preliminary heating part in the cavity, the preliminarily heated mass of the magnetic powder is moved to a main heating cavity space corresponding to the main heating part and press-formed while performing main heating in the main heating part.

* * * * *